US008775145B2

(12) United States Patent
Downton

(10) Patent No.: US 8,775,145 B2
(45) Date of Patent: Jul. 8, 2014

(54) SYSTEM AND APPARATUS FOR MODELING THE BEHAVIOR OF A DRILLING ASSEMBLY

(75) Inventor: Geoffrey C. Downton, Gloucestershire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 263 days.

(21) Appl. No.: 13/370,013

(22) Filed: Feb. 9, 2012

(65) Prior Publication Data

US 2012/0292110 A1 Nov. 22, 2012

Related U.S. Application Data

(60) Provisional application No. 61/441,667, filed on Feb. 11, 2011.

(51) Int. Cl.
*G06G 7/48* (2006.01)

(52) U.S. Cl.
USPC ..... 703/10; 175/50

(58) Field of Classification Search
CPC ..... E21B 49/00; E21B 47/022; E21B 44/02; E21B 7/04; E21B 47/024; E21B 4/02; E21B 7/00; E21B 17/00; E21B 17/10; E21B 44/00; E21B 47/02; E21B 47/026; E21B 7/24; E21B 10/00; E21B 33/10; E21B 47/00; E21B 47/16; E21B 47/18; E21B 19/16; E21B 7/06; E21B 7/08; E21B 47/06; E21B 47/08; E21D 1/06; G01V 3/18; G01V 1/40; G01V 9/00; G01V 3/00; G05B 13/04; G06F 19/00; G06F 7/544; G06F 7/60; G06G 7/48; G06T 11/20
USPC ..... 703/10; 175/24, 57, 27, 61, 40, 50, 175/325.2
See application file for complete search history.

(56) References Cited

U.S. PATENT DOCUMENTS 6,021,377 A 2/2000 Dubinsky et al.
6,233,524 B1 5/2001 Harrell et al.

(Continued)

FOREIGN PATENT DOCUMENTS

EP 1193366 A2 4/2002

OTHER PUBLICATIONS

Magdi S Mahmoud, "Robust Control and Filtering for Time Delay Systems", Neil Munro, Ph.D., D.Sc., Marvel Dekker, Inc. 2000.

(Continued)

*Primary Examiner* — Kandasamy Thangavelu
(74) *Attorney, Agent, or Firm* — Chadwick A. Sullivan; Brigitte Echols

(57) ABSTRACT

A method for drilling a borehole includes obtaining, while drilling the borehole, sensor data for the drilling assembly, analyzing, while drilling the borehole, the sensor data using a drilling behavior model to obtain results, and adjusting the drilling of the borehole based on the results. The drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length.

31 Claims, 7 Drawing Sheets

(56) References Cited

U.S. PATENT DOCUMENTS

| | | | | |
|---|---|---|---|---|
| 2009/0090555 | A1 | 4/2009 | Boone et al. | |
| 2009/0288881 | A1* | 11/2009 | Mullins et al. | 175/50 |
| 2010/0078216 | A1* | 4/2010 | Radford et al. | 175/40 |
| 2010/0139981 | A1* | 6/2010 | Meister et al. | 175/61 |
| 2011/0174541 | A1* | 7/2011 | Strachan et al. | 175/27 |
| 2011/0214920 | A1* | 9/2011 | Vail et al. | 175/57 |
| 2012/0199400 | A1* | 8/2012 | Boulet et al. | 175/325.2 |
| 2013/0341092 | A1* | 12/2013 | Hay et al. | 175/24 |

OTHER PUBLICATIONS

Stepan G., "Retarded Dynamical Systems: Stability and Characteristic Functions", Longman Scientific & Technical, 1989.

Silviu-Iulian Niculescu, Keqin Gu, "Advances in Time Delay Systems", Lecture Notes in Computational Science and Engineering, Springer-Verlag 2004, pp. 89-154.

Laurent El Ghaoui and Silviu-Iulian Niculescu, "Advances in Linear Matrix Inequality Methods in Control", John A. Burns, Society for Industrial and Applied Mathematics 2000.

Wim Michiels and Silviu-Iulian Niculescu, "Stability and Stabilization of Time Delay Systems", Ralph C. Smith, Society for Industrial and Applied Mathematics, 2007.

Richard Bellman and Kenneth L Cooke, "Differential-Difference Equations", Society for Industrial and Applied Mathematics, 2005.

Miroslav Krstic, "Delay Compensation for Nonlinear; Adaptive and PDE Systems", Birkhäuser 2009.

International search report for the equivalent PCT patent application No. PCT/US2012/024891 issued on Dec. 21, 2012.

* cited by examiner

SYSTEM AND APPARATUS FOR MODELING THE BEHAVIOR OF A DRILLING ASSEMBLY

CROSS-REFERENCE TO RELATED APPLICATIONS

This application claims benefit under 35 U.S.C. §119(e) of U.S. Provisional Patent Application No. 61/441,667, filed on Feb. 11, 2011, and entitled, "SYSTEM AND APPARATUS FOR MODELING THE BEHAVIOR OF A DRILLING ASSEMBLY," which is hereby incorporated by reference.

BACKGROUND

Many different types of wells into the Earth's subsurface exist. For example, a borehole may be drilled to create a well for accessing hydrocarbons. As another example, geothermal wells are used to access the Earth's natural heat. Continuing with the example, wells are used to access water, vent mines, rescue people from mines, and obtain hydrocarbons from a formation. Each type of borehole requires a process for drilling the well.

For example, obtaining downhole fluids (e.g. hydrocarbons) typically require a planning stage, a drilling stage, and a production stage. Each stage may be performed one or more times. In the planning stage, surveys are often performed using acquisition methodologies, such as seismic mapping to generate acoustic images of underground formations. These formations are often analyzed to determine the presence of subterranean assets, such as valuable fluids or minerals, or to determine whether the formations have characteristics suitable for storing fluids. Although the subterranean assets are not limited to hydrocarbons such as oil, throughout this document, the terms "oilfield" and "oilfield operation" may be used interchangeably with the terms "field" and "field operation" to refer to a site where any types of valuable fluids or minerals can be found and the activities required to extract them. The terms may also refer to sites where substances are deposited or stored by injecting them into the surface using boreholes and the operations associated with this process.

During the drilling stage, a borehole is drilled into the earth at a position identified during the survey stage. Specifically, a drilling rig rotates a drill string that has a bit attached. Casing may be added to ensure the structural integrity of the borehole. The trajectory, or path in which the borehole is drilled, may be controlled by a surface controller. Specifically, the surface controller controls the drill string to ensure that the trajectory is optimal for obtaining fluids.

During the completion stage, the drilling equipment is removed and the well is prepared for production. During the production stage, fluids are produced or removed from the subsurface formation. In other words, the fluids may be transferred from the subsurface formation to one or more production facilities (e.g. refineries).

SUMMARY

In general, in one aspect, embodiments relate to a method for drilling a borehole. The method includes obtaining, while drilling the borehole, sensor data for the drilling assembly, analyzing, while drilling the borehole, the sensor data using a drilling behavior model to obtain results, and adjusting the drilling of the borehole based on the results. The drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length.

In general, in one aspect, embodiments relate to a method for generating a drilling behavior model. The method includes obtaining, while drilling the borehole, initial sensor data for the drilling assembly, generating, while drilling the borehole, a partial set of coefficients using the initial sensor data, obtaining, while drilling the borehole, an actual drilling behavior of the drilling assembly, and computing, while drilling the borehole and using the partial set of coefficients in the drilling behavior model and the actual drilling behavior, a remaining set of coefficients to create a complete set of coefficients. The drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length. The method further includes storing, the complete set of coefficients. The complete set of coefficients are used in the drilling behavior model to manage the drilling of the borehole.

In general, in one aspect, embodiments relate to a system for drilling a borehole. The system includes a data repository for storing sensor data and coefficients, and a model execution hardware for executing a model engine. The model engine includes instructions for obtaining, while drilling the borehole, sensor data for the drilling assembly, analyzing, while drilling the borehole, the sensor data using a drilling behavior model to obtain results, and adjusting the drilling of the borehole based on the results. The drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length.

This summary is provided to introduce a selection of concepts that are further described below in the detailed description. This summary is not intended to identify key or essential features of the claimed subject matter, nor is it intended to be used as an aid in limiting the scope of the claimed subject matter. Other aspects will be apparent from the following description and the appended claims.

DETAILED DESCRIPTION

Figure 1:
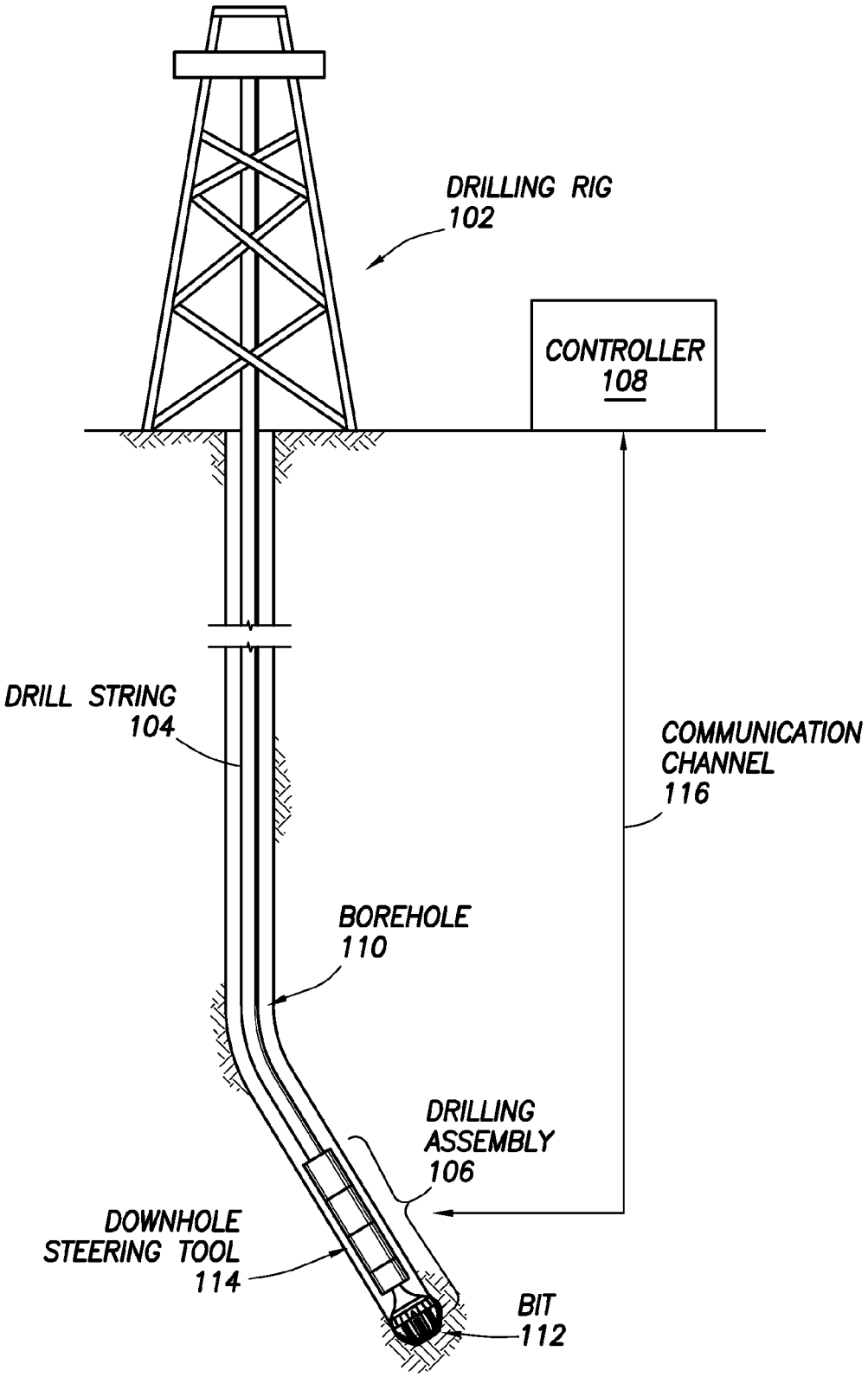
FIG. 1 shows an example drilling equipment in one or more embodiments.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding. However, it will be apparent to one of ordinary skill in the art that embodiments may be practiced without these specific details. In other instances, well-known features have not been described in detail to avoid unnecessarily complicating the description.

In general, embodiments provide a method and system for drilling a borehole. Specifically, embodiments obtain sensor data while drilling the borehole. The sensor data is analyzed using a drilling behavior model, discussed below, to obtain a set of results. Based on the set of results, the drilling of the borehole is adjusted.

In one or more embodiments, the drilling behavior model may be generated using an actual drilling behavior of the borehole. For example, if the system has only a partial set of inputs for generating coefficients in the drilling behavior model and the actual drilling behavior, the remaining coefficients may be identified. Alternatively or additionally, the actual drilling behavior may be used to update the model. Specifically, the actual drilling of the borehole may be compared with the results from analyzing the sensor data using the drilling behavior model. If a discrepancy between the actual drilling behavior and the results, then a coefficient in the model may be updated.

FIG. 1 shows a directional drilling system in one or more embodiments. As shown in FIG. 1, the system includes a drilling rig (102), a drill string (104), a drilling assembly (106), and a controller (108). Each of these components is described below.

In one or more embodiments, the directional drilling system shown in FIG. 1 has a closed loop trajectory control. In one or more embodiments, the drill string (104) provides a mechanical and hydraulic connection between the drilling assembly (106) and the drilling rig (102) at the surface. The drilling assembly (106) may be referred to as a bottom hole assembly. The drilling assembly (106) is the lower portion of the drill string (104) and may include a bit (112), stabilizers, and other components. In one or more embodiments, the drilling assembly (106) includes functionality to break the rock, survive hostile mechanical environment, and provide a driller or the controller (108) with directional control of the borehole.

In one or more embodiments, the drilling rig (102) rotates and applies axial load to the drill bit (112) via the drill string (104). The bit (112) destroys the rock and propagates the borehole (110). A fluid called "mud" is pumped down the drill string (104) to cool and lubricate the rock destruction process and to transport the rock-cuttings to the surface via the gap between borehole wall and drill string. At the surface, the cuttings may be removed and the mud may be re-circulated. The directional drilling system's downhole steering tool applies angular moments and lateral loads to the bit (112) to adjust the direction of borehole.

Sensors (not shown) may be located about the well site to collect data, may be in real time, concerning the operation of the well site, as well as conditions at the well site. The sensors may also have features or capabilities, of monitors, such as cameras (not shown), to provide pictures of the operation. Surface sensors or gauges may be deployed about the surface systems to provide information about the surface unit, such as standpipe pressure, hook load, depth, surface torque, rotary rpm, among others. Downhole sensors or gauges (i.e., sensors located within the borehole (110)) are disposed about the drilling string (104) and/or wellbore to provide information about downhole conditions, such as wellbore pressure, weight on bit, torque on bit, direction, inclination, collar rpm, tool temperature, annular temperature and tool face, and other such data. In one or more embodiments, additional or alternative sensors may measure properties of the formation, such as gamma rays sensors, formation resistivity sensors, formation pressure sensors, fluid sampling sensors, hole-calipers, and distance stand-off measurement sensors, and other such sensors. The sensor may be used to determine whether and where the drilling assembly should be steered. In other words, the downhole sensors may be spatially displaced from the drill bit and measure the drill string's angular orientation and position and, by inference, that of the borehole at the displaced locality with respect to the formation of interest (geo-steering).

The sensor data may be transmitted to the controller (108) via a communication channel (116). Although FIG. 1, shows the communication channel (116) through the earth formation, the communication channel (116) may be through the borehole (110) as is the case for mud pulse telemetry, wired drill pipe communications, and acoustic telemetry systems. The controller (108) may be located in the drill string, the surface rig, or the other side of the world. Using the drilling behavior model and the sensor data, the controller (108) may estimate borehole position and shape with respect to a desired borehole trajectory. The desired borehole trajectory is the path (i.e., trajectory) of the borehole (110) that is deemed optimal. Specifically, the controller (108) may include functionality to use the results of the modeling to identify a correction in the steering direction. The correction may be transmitted to the downhole steering tool (114) as a corrective steering command. For example, the command may be to modify a stabilizer, the bit, an actuator on the drill string, or another component.

In other words, different strategies may be used for closing the trajectory loop around a steering system. For example, an inner loop and attitude hold loop can be closed downhole. In the example, the controller may calculate the trajectory and send down new attitude set points based on the measurement while drilling (MWD) tool's indication of where the well is and where the well is going. The downhole steering tool may receive, from the controller, an angular attitude command (e.g., go to 90 degrees).

By way of another example, the downhole steering tool may be sent specific actuator commands (e.g., push with 500N force, extend pad 0.1 cm or set bend to 0.5 degree), and the MWD tool reports what is happening regarding the trajectory to the controller. In the example, the controller may compare what is happening against desired well plan and send new commands to correct.

By way of another example, the downhole steering tool may possess the well plan (i.e., with the desired trajectory for drilling the well) in the memory of the downhole steering tool. In the example, the downhole steering tool has access to all the surface and downhole measurements, and the downhole steering tool generates its own commands. The surface may only intervene to override actions or to send a new well plan.

By way of another example, the downhole steering tool may be provided, such as from the controller, with geophysical and/or petro physical objectives. In the example, the downhole steering tool may create its own well plan dynamically.

Rather than the controller analyzing the sensor data, the sensor data may be analyzed by the downhole steering tool (114). Specifically, the downhole steering tool (114) may include functionality to receive sensor data and analyze the sensor data using the drilling behavior model in one or more embodiments. The downhole steering tool (114) may further include functionality to update the drilling assembly based on the results of the drilling behavior model.

Although not discussed in FIG. 1 above, the drilling behavior model may be used to model the drilling behavior of a drilling assembly lacking any subsurface steering element (i.e., possesses no active steering means). For example, the drilling behavior model may model the drilling behavior of a drilling assembly that is steered by gravity.

Although not shown or discussed in FIG. 1, in one or more embodiments, the methodologies and components disclosed below are applicable to other types of boreholes. For example, embodiments disclosed below are applicable to drilling a borehole to access water, vent mines, rescue people from mines, create a geothermal well, along with other types of wells. Accordingly, drilling boreholes for other purposes are included without departing from the scope of the claims.

Although not shown in FIG. 1 or discussed above, embodiments are applicable to drilling tractors. A drilling tractor propels itself to drill a well. A drilling tractor may lack a drill string and be powered by electricity. Further, embodiments are applicable to coil tube drilling.

Figure 2:
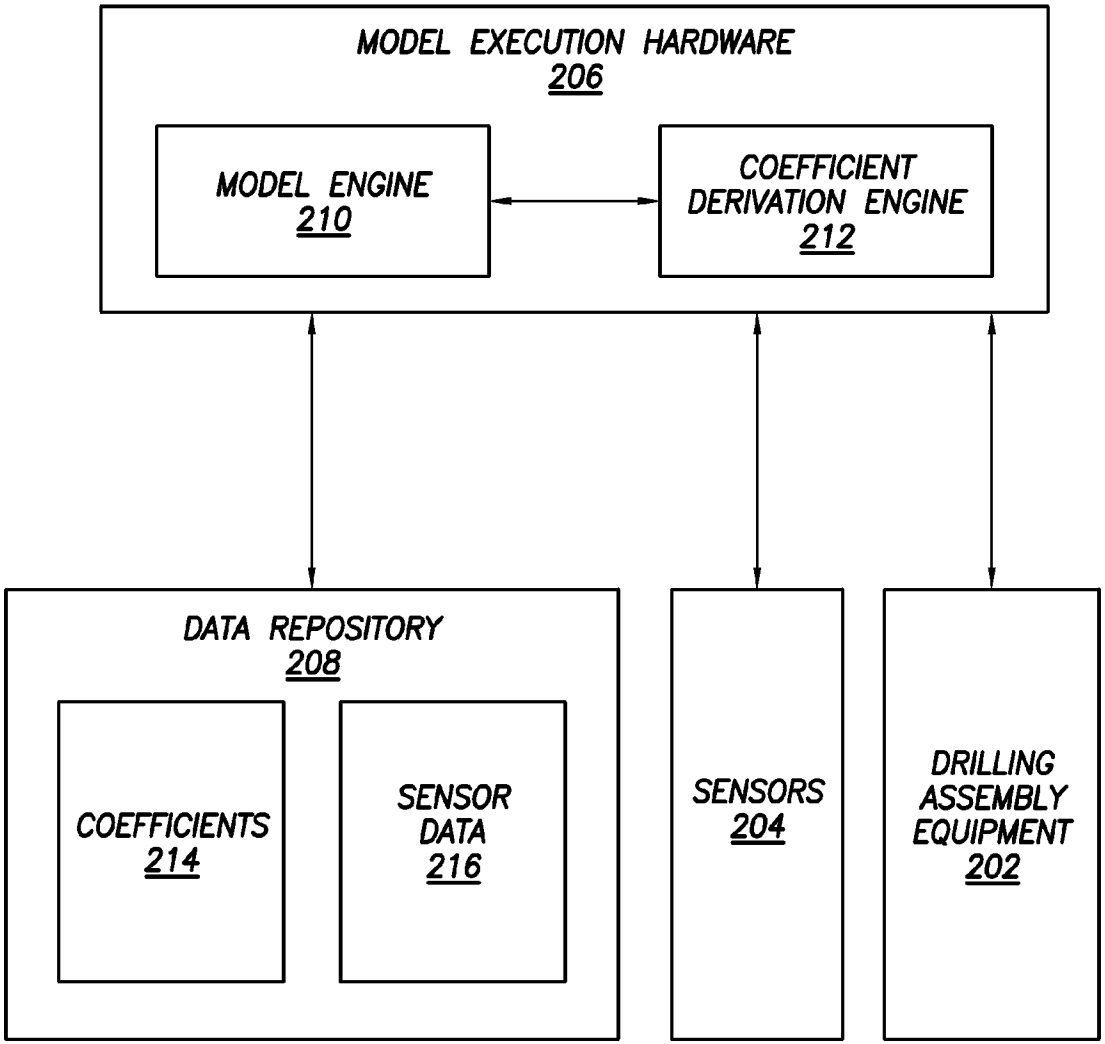
FIG. 2 shows an example system in one or more embodiments.

FIG. 2 shows an example system in one or more embodiments. As shown in FIG. 2 the system includes drilling assembly equipment (202), sensors (204), model execution hardware (206), and a data repository (208). Each of these components is described below.

The drilling assembly equipment (202) corresponds to the physical equipment of the drilling assembly. For example, the drilling assembly equipment may include one or more displacement actuators or stabilizers, one or more bits, a mud motor, drill collars, drill pipe, and other components. Additionally, the drilling assembly equipment (202) may include and/or be connected to one or more sensors (204). The sensors may correspond to the sensors discussed above with respect to FIG. 1.

In one or more embodiments, the model execution hardware (206) corresponds to one or more physical devices for executing the model. For example, the model execution hardware (206) may be a computer system, such as the computer system shown in FIG. 7. By way of another example, the model execution hardware (206) may be the controller or downhole steering tool, such as the controller and downhole steering tool shown in FIG. 1. Additionally or alternatively, the model execution hardware (206) may be or may include an embedded processor and associated memory, such as an embedded processor and associated memory embedded in the steering system and/or the controller. The model execution hardware (206) includes a model engine (210) and a coefficient derivation engine (212) in one or more embodiments. The model engine (210) and/or the coefficient derivation engine (212) may correspond to software, hardware, or the combination of software and hardware. The model engine (210) includes functionality to analyze sensor data using the drilling behavior model. For example, the model engine (210) performs the functionality of the drilling behavior model (discussed below) to analyze sensor data.

The coefficient derivation engine (212) includes functionality to derive coefficients for the drilling behavior model in one or more embodiments. Specifically, the coefficients correspond to constant values that are used in the drilling behavior model. The coefficient derivation engine (212) includes functionality to generate an initial set of coefficients based on one or more inputs from sensors. Additionally or alternatively, the coefficient derivation engine (212) includes functionality to obtain or generate an initial set of coefficients based on prior stored data (e.g., based on a nominal calculated set, historical data describing what was used in a similar situation before). Additionally, in one or more embodiments, the coefficient derivation engine (212) includes functionality to compare an actual drilling behavior with results generated from the drilling behavior model to determine whether the results match. In other words, the coefficient derivation engine includes functionality to determine whether the drilling behavior model is accurate. If a discrepancy exists, then the coefficient derivation engine includes functionality to revise the model by modifying the value of one or more coefficients.

The model engine (210) and the model execution hardware (212) may be located on a single device or multiple devices of the system. For example, the model engine (210) may be performed by the downhole steering tool while the coefficient derivation engine (212) may be performed by the controller. In such an example, the model execution hardware may include all or a portion of each of the downhole steering tool hardware and the controller. The model execution hardware, the data repository (discussed below), and the model engine may be located, together or separately, anywhere without departing from the scope of the claims.

Continuing with FIG. 2, in one or more embodiments, the data repository (208) is any type of storage unit and/or device (e.g., memory, a file, a file system, database, collection of tables, or any other storage mechanism) for storing data. Further, the data repository (208) may include multiple different storage units and/or devices. The multiple different storage units and/or devices may or may not be of the same type or located at the same physical site. For example, the data repository may include a portion at the controller and another portion at the downhole steering tool. In one or more embodiments, the data repository (208), or a portion thereof, is secure.

The data repository (208) includes functionality to store the coefficients (214) and the sensor data (216). The coefficients stored in the data repository (208) are the coefficients of the drilling behavior model. The sensor data (216) may correspond to the sensor data discussed above with respect to FIG. 1.

As shown in FIG. 2, the sensor data (216) may be stored by the model execution hardware in one or more embodiments. In one or more embodiments, the model execution hardware (204) may include functionality to obtain the sensor data directly from one or more sensors and store the sensor data. Alternatively or additionally, although not shown in FIG. 2, the sensors may include functionality to store the sensor data directly in the data repository, bypassing the model execution hardware (206). Alternatively or additionally, although not shown in FIG. 2, another component or device may include functionality to obtain the sensor data from the sensors and store the sensor data in the data repository.

Although not shown in FIG. 2, the data repository may include multiple versions of the drilling model. The multiple versions may be used to provide a means of interpolation between the multiple versions given a parameter dependency, such as weight on bit or bit anisotropy (e.g., tables of values versus weight on bit, etc.).

While FIGS. 1 and 2 show certain configurations of components, other configurations may be used without departing from the scope of the claims. For example, various components may be combined to create a single component. As another example, the functionality performed by a single component may be performed by two or more components.

Figure 3:
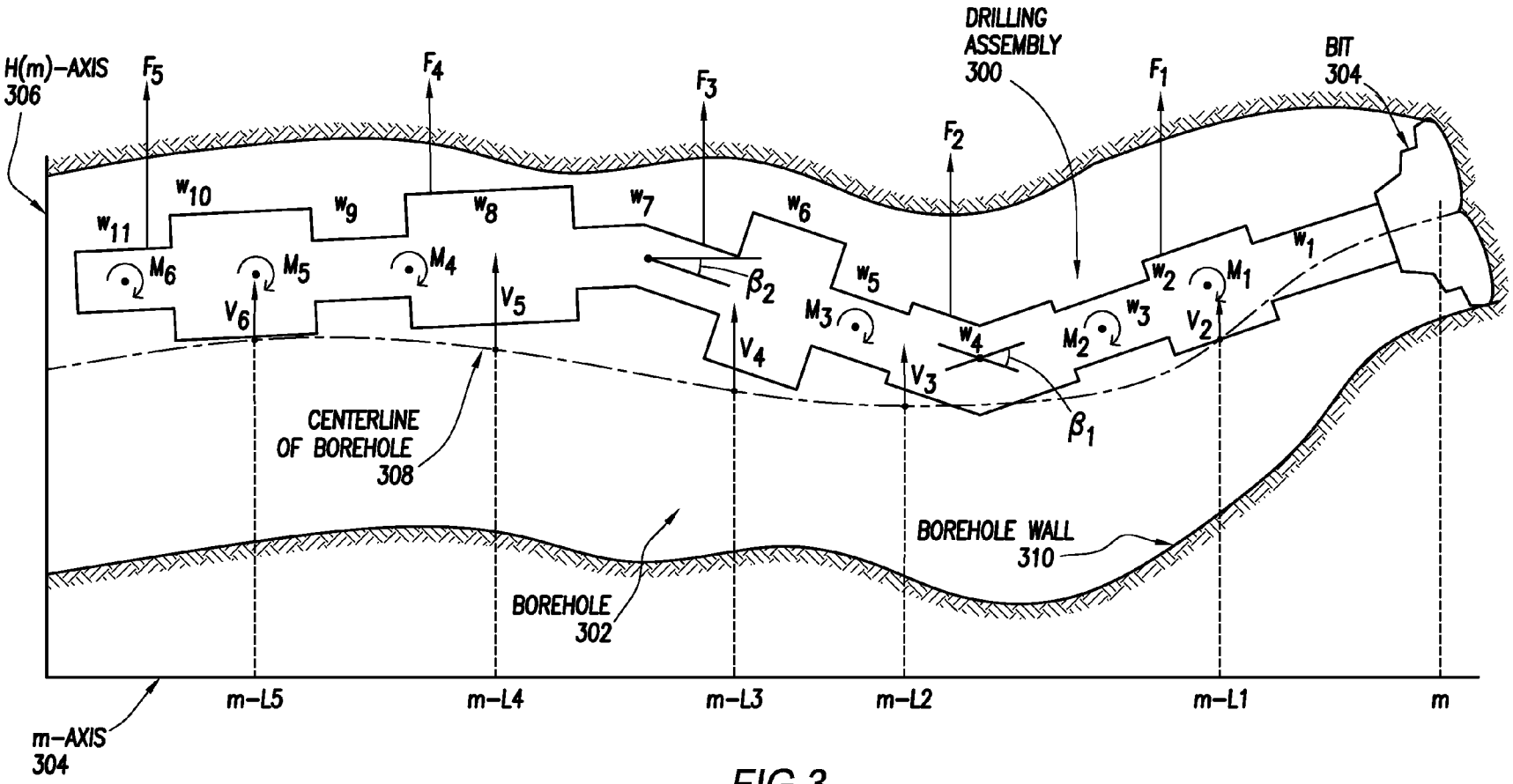
FIG. 3 shows an example drilling assembly in one or more embodiments.

FIG. 3 shows a schematic diagram of an example drilling assembly in one or more embodiments. Specifically, FIG. 3 shows the example drilling assembly (300) as the drilling assembly is in the borehole (302). The drilling assembly (304) includes at least one bit (i.e., drilling bit) for drilling the borehole (302). Although not shown in FIG. 3, the drilling behavior model may be used, for example, where an hole opener (e.g., reamer) is placed further along the drill string. Such hole opener may be used, for example, in deep water applications where the hole is required to be of a larger diameter than the pass-through diameter of the casing above (e.g., to allow more diameter for a good cement job). In such a scenario, multiple bits may be used and two borehole centerlines may be modeled by the drilling behavior model (e.g., the hole from the bit and the hole from the reamer).

In the example FIG. 3, the m-axis (304) is nominally parallel to the direction of hole propagation. In other words, the drilling behavior model may use small angle approximations to simplify the model. Thus, the m-axis may be realigned with the developing borehole or when the small angle approximation no longer works. Thus, m is the distance drilled. Because the m-axis is an axis along the direction of hole propagation, the m-axis (304) is also along the length of the drilling assembly (300) as shown in FIG. 3. The distance H(m-x) (306) represents the lateral displacement at the point m-x (i.e., at a distance x back from the bit). H(m) is the lateral displacement from the center of the borehole at the bit (304) because x=0. In one or more embodiments, if the steering system from the point of entering the ground drilled in the same direction, then "m" is the length of the drill string. In one or more embodiments, the drilling behavior model requires that the m-axis is nominally parallel to the drill string over that length L5 sufficient for small angle approximations to be effective. The centerline of the borehole (308) is a line along the center of the borehole. Thus, the centerline (308) is equidistant from each of the borehole walls (310).

FIG. 3 depicts where values for various variables may be found. In the following discussion, the use of subscript, "j", means the $j^{th}$ position in the set. For example, in FIG. 3, $w_j$ is the variable w at the $j^{th}$ position. The position is defined with respect to the remaining variables in the set.

Continuing with the discussion, $w_j$ is a length of evenly distributed weight. In other words, the length of each $w_j$ is the maximum length until the weight per unit length changes. In FIG. 3, for $w_j$, j may have a value between one and eleven (i.e., $w_1, w_2, \ldots w_{11}$). In other words, there are eleven lengths of evenly distributed weights per unit length. For example, per unit length, $w_3$ has a different weight than $w_2$ and $w_4$. However, within the length of $w_3$, the weight of the portion of the drilling assembly is evenly distributed. Similarly, by way of another example, per unit length, $w_8$ has a different weight than $w_9$ and $w_7$. However, within the length of $w_8$, the weight of the portion of the drilling assembly is evenly distributed. In one or more embodiments, in actuality, the drill string may have weights per unit length that are quite complex and have multiple sections. In such a scenario, the number of $w_i$ are chosen as needed to approximate the actual situation to the required accuracy.

In the following, in one or more embodiments, the drilling behavior model resolves forces, loads, and bends into formation fixed axes. In other words, in such embodiments, the bend is established in a geostationary sense (i.e., it does not wobble). The same may be used for displacement actuators, the forces, and moments applied.

In one or more embodiments, the variable, "$\beta_j$", is captured at a bend angle j. As shown in FIG. 3, the drilling assembly (300) has two bend angles (i.e., j=1 or 2 in FIG. 3). $\beta_1$ is obtained at the first bend angle. $\beta_2$ is obtained at a second bend angle. The variable, "$\beta_j$" is an angular offset at the $j^{th}$ bend angle.

The variable, "$L_j$", represents element j of the drilling assembly. Each element is a touch point. In the diagram in example FIG. 3, five touch points exist (shown by $L_1$ to $L_5$). In one or more embodiments, a touch point may be a displacement actuator. More generally, a touch point may be a position of a stabilizer. A stabilizer is a portion of the drillstring which has a diameter close to that of the hole being drilled and serves the purpose in moving the centerline of the drillstring close to that of the borehole (302). In other words, a stabilizer may stabilize the drillstring and limits the motion of the drillstring. Thus, the stabilizer constrains the lateral movement of the drilling assembly.

The variable, "$v_j$", is captured at a touch point and at the bit. As discussed above, in the example, five touch points and one bit exist. Thus, $v_1$ to $v_6$ are shown in FIG. 3. The variable, "$v_j$", is the distance from the center of the drilling assembly to the centerline of the borehole (308) at the $j^{th}$ position or touch point.

The variable, "$F_j$", is force measured at the $j^{th}$ position. By way of examples, the $j^{th}$ position may be a position of a force actuator or a position in which a pad pushes into the borehole walls. In the case of a force actuator, the drillstring may deflect as a spring does. In the case of a displacement actuator, the drillstring does what it is commanded. In the example, there are five positions in which a force is measured as acting on the borehole walls. Thus, $F_1$ to $F_6$ are those positions shown in FIG. 3.

The variable, "$M_j$", is the external moment applied to the drilling assembly at the $j^{th}$ position. An external moment is the tendency to rotate as caused by external forces. $M_j$ is the tendency to rotate the $j^{th}$ position. As shown in FIG. 3, six positions exist in the example drilling assembly (300) in which the drilling assembly has the tendency to rotate. Thus, for $M_j$, j may have a value of one to a value of six in the example FIG. 3.

As discussed above, FIG. 3 shows an example drilling assembly with example positions of variables for the drilling behavior model. In one or more embodiments, the general form of the drilling behavior model may be expressed using the equation:

$$H(s) = \frac{\sum_{i=1}^{i=N}(CH_i \cdot v_i(s)) + \sum_{k=1}^{k=X}(CB_k \cdot \beta_k(s)) + \sum_{l=1}^{l=P}(CM_l \cdot M_l(s)) + \sum_{n=1}^{n=Q}(CF_n \cdot F_n(s)) + \sum_{r=1}^{r=Y}(CW_r \cdot w_r(s))}{s + CG \cdot s^2 - CH_1 - CH_2 \cdot e^{-sL_1} - \sum_{j=2}^{j=N} CH_{j+1} \cdot e^{-sL_1 j}}$$

In the above equation, N is a number of touch points, X is a number of bend angles, P is a number of external moments, Q is a number of external forces, and Y is a number of lengths of distributed weights. Returning briefly to the example of FIG. 3, if the above equation is applied to the example of FIG. 3, the value of N is 6, the value of X is 2, the value of P is 6, the value of Q is 5, and the value of Y is 11 in one or more embodiments.

Continuing with the discussion of the general form of the drilling behavior model, H(s) is a Laplace Transform of H(m), where m is a distance drilled, and s is a Laplace Transform variable. In other words H(m) is the lateral displacement of the center line of the hole and H(s) is the Laplace Transform of H(m), with m as the independent variable in the Laplace Transformation process. Alternatively, the Laplace Transforms may be taken as a function of time. In such a scenario, with a suitable transformation using a function of time, the drilling behavior model may use an equivalent H(s) by substituting m with its time equivalent. The alternative form of substituting time for the Laplace Transform or any alternate variable substitutions for m is included without departing from the scope of the claims.

Further, $CH_i$ is a vertical displacement coefficient at an $i^{th}$ position. $v_i(s)$ is the Laplace Transform of a vertical displacement from a centerline of the borehole at the $i^{th}$ position. For example, $v_i$ is a vertical displacement of the centerline downhole assembly from center of borehole as generated at the $i^{th}$ actuator position by an $i^{th}$ displacement actuator. $v_i(s)$ is the Laplace Transform of $v_i$.

$CB_k$ is an angular coefficient at a $k^{th}$ position. $\beta_k(s)$ is the Laplace Transform of an angular offset at the $k^{th}$ position. For example, $\beta_k$ is an angular offset or tilt at the $k^{th}$ position. $\beta_k(s)$ is the Laplace Transform of $\beta_k$. $CM_l$ is a total displacement coefficient at an $l^{th}$ position. $M_l(s)$ is the Laplace Transform of an external moment at the $l^{th}$ position. For example, $M_l$ is an external moment applied to the drilling assembly at the $l^{th}$ position. $M_l(s)$ is the Laplace Transform of $M_l$. $CF_n$ is a coefficient of force at an $n^{th}$ position. $F_n(s)$ is the Laplace Transform of force, $F_n$, at the $n^{th}$ position. $CW_r$ is a mass per unit length coefficient at an $r^{th}$ position. $w_r(s)$ is the Laplace Transform of mass per unit length for the $r^{th}$ position. For example, $w_r$ is a mass per unit length at the $r^{th}$ position. $w_r(s)$ is the Laplace Transform of $w_r$. e is the base of the natural logarithm. CG is a coefficient moment to tilt the bit. Specifically, CG is a coefficient that relates the reactive moment required to tilt the bit into the rock about an axis perpendicular to the page in example FIG. 3 at a given angular change per distance drilled. For example, a bit which has a long length will take a lot more moment to tilt than a bit with a short length. The CG may be a reactive moment on the bit that is proportional to the borehole curvature to account for the moments a long length bit may experience an oscillatory hole of short wavelength. $L_i$ is an element i of a drill string. $CH_{j+1}$ is a coefficient at a $(j+1)^{th}$ position. $L\mathbf{1}_j$ is a distance from element 1 to element Lj. Specifically, $L\mathbf{1}=L_1$, $L\mathbf{12}=L\mathbf{1}+L_2$, $L\mathbf{13}=L\mathbf{12}+L_3$, . . . , $L\mathbf{1}N=L\mathbf{1}(N-1)+L_N$. Thus, $(-s*L\mathbf{1}j)$ of e accounts for the existence of a delay within in the system. Specifically, the touch point defines a delayed point with respect to the bit.

In one or more embodiments, the drilling behavior model may be expressed using the derivative form of H(m). Specifically, the drilling behavior model may be expressed using the following equation:

$$\frac{dH}{dm} = \sum_{i=1}^{i=N} (CH_i \cdot (H_i + v_i(m)) + \sum_{k=1}^{k=X} (CB_k \cdot \beta_k(m)) + \sum_{l=1}^{l=P} (CM_l \cdot M_l(m_l)) + \sum_{n=1}^{n=Q} (CF_n \cdot F_n(m)) + \sum_{r=1}^{r=Y} (CW_r \cdot w_r(m)) - CG \cdot \frac{d^2 H}{dm^2}$$

The same terms or variables in the above equation are the same as the identically named terms in the prior equation. Further, in the above equation, $H_j=H(m-L\mathbf{1}j)$ and $d^2H/dm^2$ is the second derivative. Using the above equation, the coefficients may be variables and may function as other variables. Further, the above equation provides for estimation of the coefficients using, for example, a linear or nonlinear recursive least squares approach.

The above drilling behavior model is a planar model. In one or more embodiments, an orthogonal model may be created to analyze the drilling in three dimensions. The general form of the expression for the orthogonal model may match the expression above. Specifically, the general form of the expression for steering in two orthogonal planes may consist of two H(s) expressions, one for each plane in one or more embodiments. Depending on the amount of cross coupling between the two planes (e.g., from the bit), a new composite expression can be derived using the same method. If the bottom hole assembly is instrumented and all external inputs are known then the two planes may be treated separately.

Figure 4:
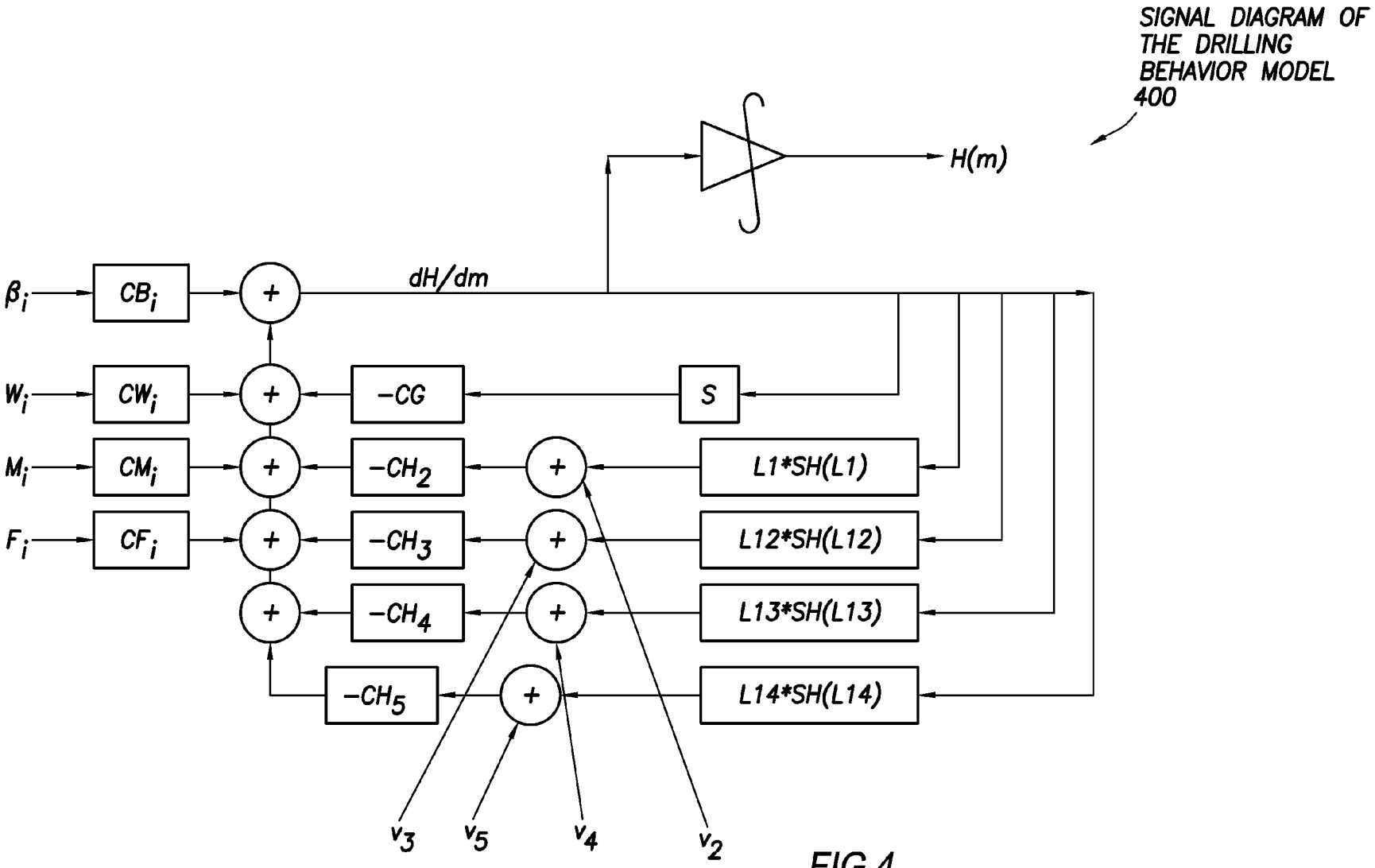
FIG. 4 shows an example drilling behavior model in one or more embodiments.

Continuing with the discussion, the drilling behavior model may be expressed using any one of multiple substantially equivalent equations without departing from the scope of the claims. In other words, other forms of expressing the drilling behavior model are included herein. For example, FIG. 4 shows an example signal diagram of the drilling behavior model (400) in one or more embodiments. The signal diagram (400) shown in FIG. 4 corresponds to an example in which the drilling assembly has four touch points. Specifically, the signal diagram shown in FIG. 4 corresponds to the drilling behavior model expressed using the following equation specified for four touch points:

$$H(s) = \frac{CH_i \cdot v_i(s) + CB_i \cdot \beta_i(s) + CM_i \cdot M_i(s) + CF_j \cdot F_j(s) + CW_j \cdot w_j(s)}{s + CG \cdot s^2 - CH_1 - CH_2 \cdot e^{-sL_1} - CH_3 \cdot e^{-sL_{12}} - CH_4 \cdot e^{-sL_{13}} - CH_5 \cdot e^{-sL_{14}}}$$

In one or more embodiments, the variables presented in the above equation are the same as the variables presented in the general form.

Figure 5:
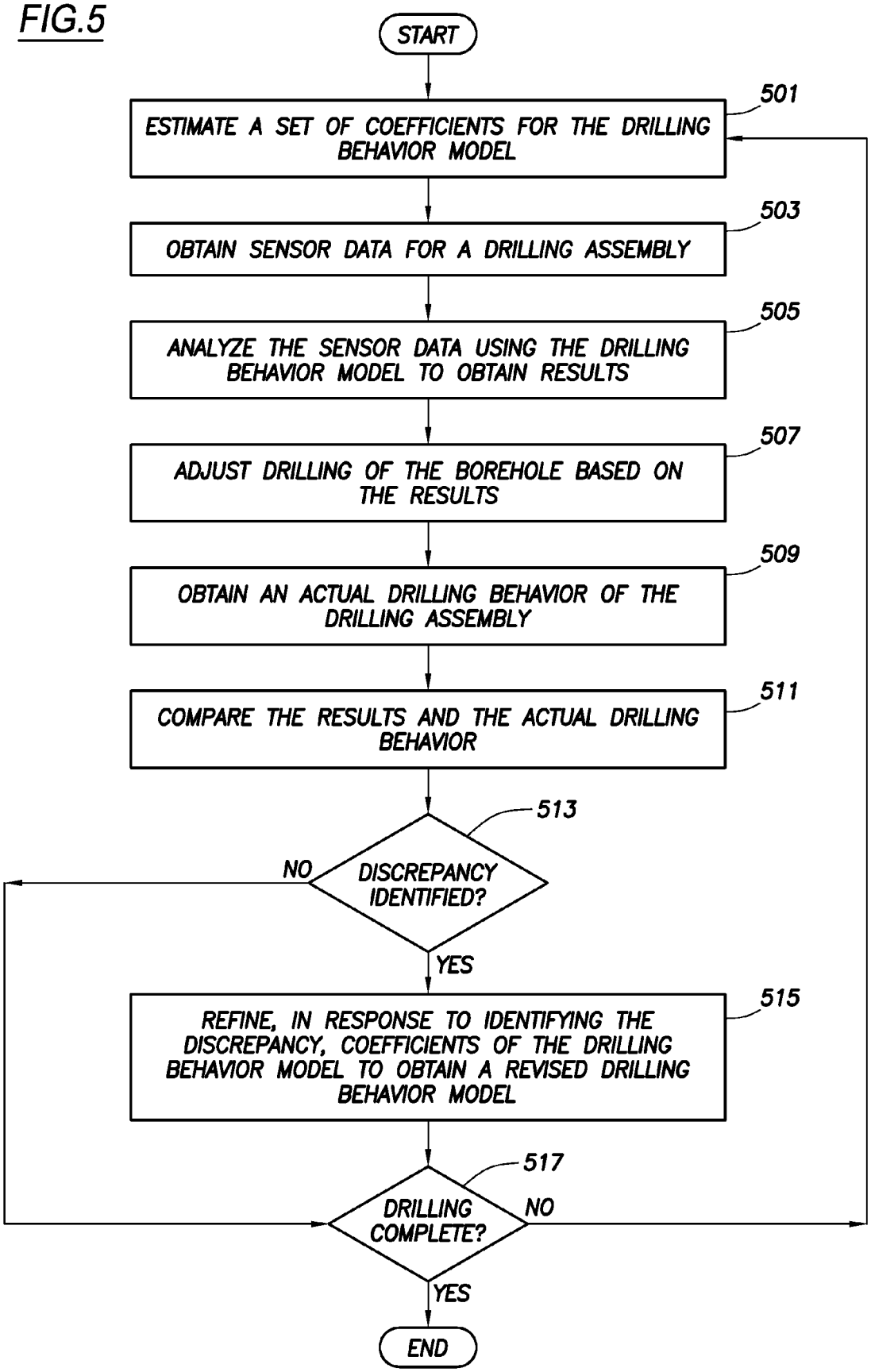
FIG. 5 shows an example method for drilling a borehole in one or more embodiments.
Figure 6:
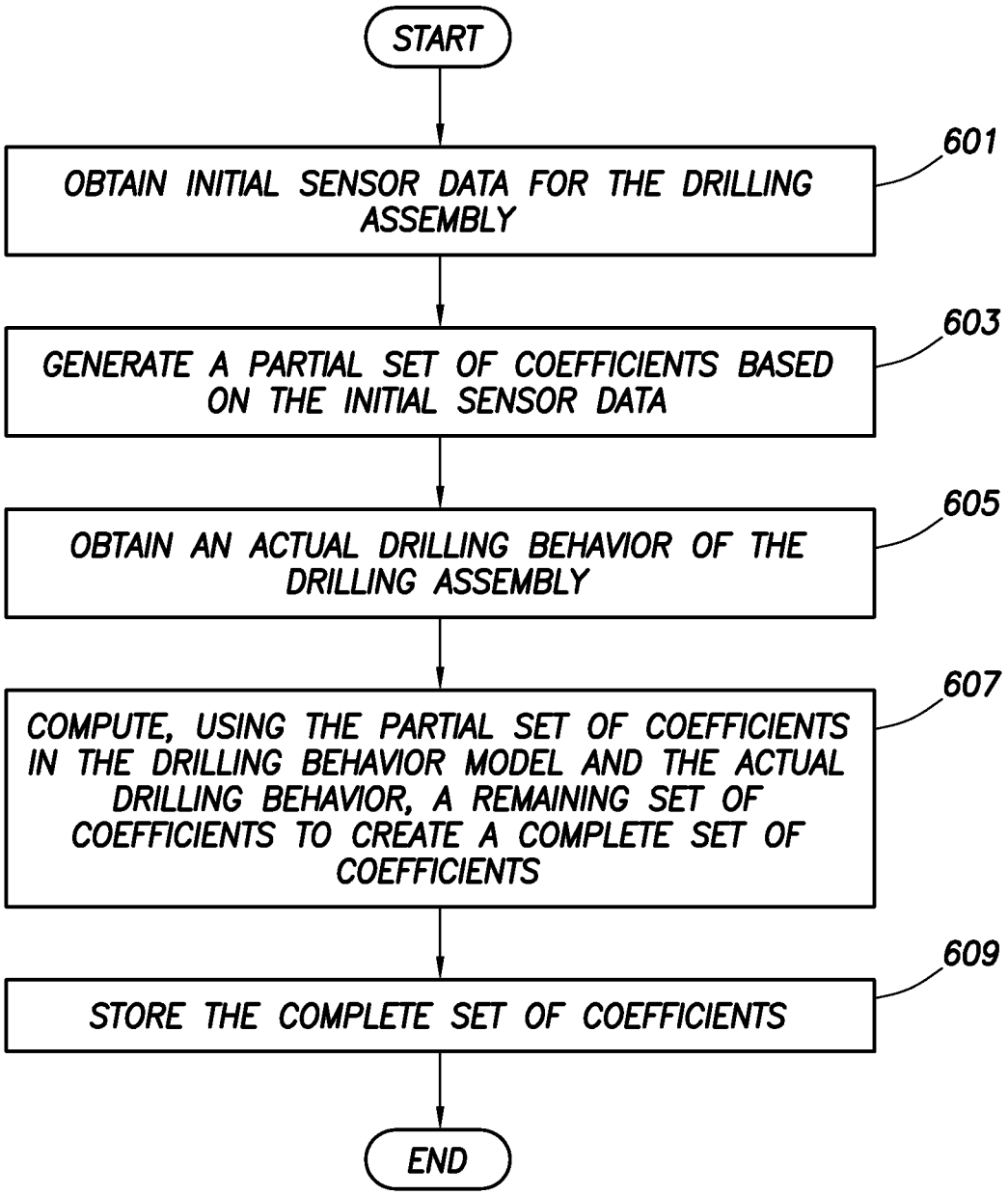
FIG. 6 shows an example method for identifying coefficients in the drilling behavior model in one or more embodiments.

FIGS. 5 and 6 show flowcharts in one or more embodiments. While the various steps in this flowchart are presented and described sequentially, one of ordinary skill will appreciate that some or all of the steps may be executed in different orders, may be combined or omitted, and some or all of the steps may be executed in parallel. Furthermore, the steps may be performed actively or passively. For example, some steps may be performed using polling or be interrupt driven in accordance with one or more embodiments. By way of an example, determination steps may not require a processor to process an instruction unless an interrupt is received to signify that condition exists in accordance with one or more embodiments. As another example, determination steps may be performed by performing a test, such as checking a data value to test whether the value is consistent with the tested condition in accordance with one or more embodiments.

FIG. 5 shows a flowchart for drilling a borehole in one or more embodiments. In 501, a set of coefficients for the drilling behavior model is estimating. Estimating the set of coefficients is discussed below and in FIG. 6.

Continuing with FIG. 5, in 503, sensor data for a drilling assembly is obtained. In one or more embodiments, the sensor data may be obtained directly or indirectly from various sensors in the borehole. Additional sensors dispersed throughout the oilfield may also provide the sensor data. Obtaining the sensor data may be performed, for example, by the sensors detecting information about the drilling assembly and environmental conditions of the borehole and transmitting the sensor data to the model execution hardware and/or the data repository. Although not shown in FIG. 5, the sensor data may be preprocessed prior to being used in the drilling behavior model.

In 505, the sensor data is analyzed using the drilling behavior model to obtain results. As discussed above, the drilling behavior model includes various variables. Certain variables, such as the various weights per unit length may be constant for a particular drilling assembly regardless of the position of the drilling assembly in the borehole. The values for such constant variables may be stored and obtained from the data repository. Other variables, such as the bend angles, may be extracted from the sensor data. The model engine obtains the values for the various variables and the estimation of the coefficients. The model engine uses the values of various variables and the estimation of the coefficients in the drilling behavior model to obtain a set of results.

In one or more embodiments, dH(m)/dm captures the instantaneous direction of hole propagation and is, by linear superposition, the sum of all the effects of inputs $v_i$, $F_i$, etc. and the shape of the hole defined by H(m) and the delayed touch points.

In 507, the drilling of the borehole is adjusted based on the results in one or more embodiments. In one or more embodiments, a downhole steering tool may perform the analysis of 505 and adjust the drilling of the borehole. By the downhole steering tool performing the analysis and adjustment, delay resulting from communicating with the surface is bypassed. The adjustments may be performed, for example, by the downhole steering tool sending command signals to the various components of the drilling assembly. Additionally or alternatively, the adjustments may be made while drilling the borehole. Adjusting the drilling of the borehole may include modifications to one or more stabilizers of the drilling assembly. For example, a position and/or diameter of one or more stabilizers may be modified. Adjusting the drilling may include modifying a bit on the drilling assembly. For example, a shape of a gauge of the bit, a position of a cutter on the bit, and/or a position of snubbers on the bit may be modified. Additionally or alternatively, a lateral force and position of at least one actuator may be modified in one or more embodiments. Additionally or alternatively, adjusting the drilling behavior may include adjusting a weight of the bottom hole assembly and/or a cross section of a tubular in the bottom hole assembly.

As another example, the cross sections of the tubulars within the bottom hole assembly may be modified to achieve a change in tubular stiffness. The change in tubular stiffness alters the response of the hole propagation system to optimize a steering objective, such as to improve the stability of the steering loop or to reduce stiffness to achieve a short term ability to achieve a high dogleg. Changing the cross section may be achieved by a telescoping of two concentric tubular or a relative rotation of two concentric tubular where this causes the stiffness of either tubular to be removed from the picture (e.g., the align/mal-align of castellated ribs).

Although not discussed above and in FIG. 5, rather than or in addition to modifying the drilling of the borehole, the results may be analyzed to identify a shape of the borehole. Specifically, by improving the estimate of the coefficients to construct a more accurate model, the knowledge of the shape of the borehole improves. In other words, the borehole shape may be reconstructed between the touch points analytically because the drilling behavior model models the shape of the borehole rather than the drilling assembly itself in one or more embodiments. For example, the MWD may be set back from the bit by a particular predefined distance and the drilling behavior model may be used to predict to the shape and position of the hole from MWD to bit. In one or more embodiments, the particular predefined distance may be a considerable distance from the bit and/or may be defined by an operator of the drilling tool.

Although not discussed above and in FIG. 5, rather than or in addition to modifying the drilling of the borehole, the derivative of the drilling behavior model may be used to identify the stability of borehole propagation. Specifically, the drilling behavior model may be used to optimize the form of the borehole and avoid having a system that generates a wavy or spiraling hole due to its inherent hole propagation characteristics.

Although not discussed above and in FIG. 5, the drilling behavior model may further be used for other purposes, such as to identify loop stability, design in real time new control laws, determine whether the tool can attain the required curvature response, and perform other functions. As another example, the drilling behavior model may model lateral displacement, angular orientation, and/or a curvature of the borehole at a predefined point on the drillstring. By way of another example, the drilling behavior model identifies a failure of the borehole based on at least one coefficient of the drilling behavior model exceeding a predefined threshold. By way of another example, the drilling behavior model models the drilling of the borehole when a working actuator is used to compensate for a failed actuator.

Continuing with FIG. 5, in 509, an actual drilling behavior of the drilling assembly is obtained. Specifically, after the drilling of the borehole is analyzed, additional sensor data may be gathered. The additional sensor data may be used to determine how the borehole is being drilled with the modification in 507.

In 511, the results obtained in 505 are compared to the actual drilling behavior obtained in 509. In 513, a determination is made whether a discrepancy is identified. Specifically, a determination is made whether the expected drilling behavior in the results matches the actual drilling behavior. If a discrepancy does not exist, then the method may proceed to Step 517. If a discrepancy exists, the method may proceed to Step 515.

In 515, in response to identifying the discrepancy, the coefficients of the drilling behavior model are refined to obtain a revised drilling behavior model. Specifically, the coefficients estimated in Step 501 are updated based on the actual drilling behavior.

In 517, a determination is made whether the drilling is complete. For example, a determination may be made whether the target location to drill the borehole is reached.

In the case of a borehole drilled for a hydrocarbon well, for example, if the target location is reached, then the flow may proceed to completion stage and then to production stage to obtain hydrocarbons from the borehole. If the target location is not reached, the operator of the drilling assembly may decide to abandon drilling, abandon using the drilling behavior model, or continue drilling using the drilling behavior model. If the determination is made to continue drilling using the drilling behavior model, the flow may proceed to 503 to continue gathering sensor data for the drilling assembly. Thus, one or more embodiments provide for real-time update of the current status of the drilling of the borehole and real-time modifications to the drilling of the borehole while drilling the borehole.

By way of other examples, if the target location is reached, the flow of the method may proceed to removing drilling equipment, adding any other equipment, if necessary, and extracting the target object from the well, such as obtaining heat, in the case of a geothermal well, obtaining water, rescuing trapped people, or to remove hazardous substances (e.g., vent a mine).

FIG. 6 shows a flowchart for estimating coefficients of the drilling behavior model in one or more embodiments. In 601, initial sensor data for the drilling assembly is obtained. Obtaining the initial sensor data may be performed using a similar method discussed above and in 503.

In 603, a partial set of coefficients is generated based on the initial sensor data. Generating the partial set of coefficients may be performed using a variety of mathematical equations. Thus, from the MWD surveys, knowledge of the resultant the shape of the hole, knowledge of the inputs, the coefficients may be estimated. In other words, knowing H(m) samples from the survey data and the inputs means that the coefficients may be identified. In one or more embodiments, the coefficients of the terms are nominally constant for a given weight on bit, revolutions per minute, rock type, formation, or other given or may be assumed to be nominally constant for all practical purposes etc. Each coefficient may have a complex algebraic form with components that are capable of being determined by mechanical properties that are well known. Further, in one or more embodiments, a well instrumented tool may only require a little estimation (e.g., to determine the effects of bit anisotropy) while less instrumented tools may require more estimation.

Known techniques that may be used for estimating coefficients explicitly or implicitly as may be needed for closed loop control are described in the following references: Magdi S Mahmoud, *Robust Control and Filtering for Time Delay Systems* (Neil Munro, Ph.D., D.Sc., Marvel Dekker, Inc. 2000); Stepan G., *Retarded Dynamical Systems: Stability and Characteristic Functions* (Longman Scientific & Technical, 1989); *Advances in Time Delay Systems* 89-154 (Silviu-Iulian Niculescu, Keqin Gu, Springer-Verlag 2004); Laurent El Ghaoui and Silviu-Iulian Niculescu, *Advances in Linear Matrix Inequality Methods in Control* (John A. Burns, Society for Industrial and Applied Mathematics 2000); Wim Michiels and Silviu-Iulian Niculescu, *Stability and Stabilization of Time Delay Systems,* (Ralph C. Smith, Society for Industrial and Applied Mathematics, 2007); Richard Bellman and Kenneth L Cooke, *Differential-Difference Equations,* (Society for Industrial and Applied Mathematics, 2005); and Miroslav Krstic, *Delay Compensation for Nonlinear; Adaptive and PDE Systems* (Birkhäuser 2009).

In 605, the actual drilling behavior of the drilling assembly is obtained. Obtaining the actual drilling behavior may be performed as discussed above with reference to 509.

In 607, using the partial set of coefficients in the drilling behavior model and the actual drilling behavior, a remaining set of coefficients are computed to create a complete set of coefficients. For example, the above expression of the drilling behavior model, first derivative of the above expression, and/or second derivative of the above expression may be used with the actual drilling behavior, the sensor data, and the partial set of coefficients to obtain the missing coefficients. In the example, the sensor data and the actual drilling behavior provides the set of variables for the drilling behavior model and the results. Thus, by using the partial set of coefficients, the remaining coefficients may be calculated from the drilling behavior model.

In 609, the complete set of coefficients is stored. In other words, the remaining set of coefficients and the partial set of coefficients may be stored in the data repository.

The coefficients may be used in the drilling behavior model to, for example, decide how to close the loop around the tool (e.g., what gains to use in an inclination hold loop), and determine whether the drilling assembly is capable of achieving the desired trajectory. Determining whether the drilling assembly is capable of achieving the desired trajectory is useful in forward planning of the well. For example, if a decision is made that the system has a weak response, then a determination may be made to start to turn the well sooner rather than later in the drilling process. Additionally or alternatively, the coefficients may be used in the drilling behavior model to identify dysfunctions in the drilling system, such as danger of an imminent twist off. For example, the coefficient estimation may indicate that the bottom hole assembly was getting overly flexible, that the lateral cutting of the bit had worn out, or that an actuator was failing due to a weak response.

Additionally or alternatively, the coefficients may be used in the drilling behavior model to optimize steering in general where, for example, an actuator is beginning to fail, performance can be regained by making more use of an alternative actuator (e.g., switching on another force actuator, reducing the WOB so the tool can turn more easily with a weaken force actuator, etc.). Additionally or alternatively, the coefficients may be used in the drilling behavior model to estimate where the touch points are located. For example, if the span between the stabilizers/displacement actuators/vi is too long, the drilling assembly may touch-down on the hole in an un-modeled manner. However if a parameter estimation loop is constantly predicting where these touch points are then any spurious changes can be detected and suitable action taken, such as to prevent the closed loop part of the system from reacting improperly.

Figure 7:
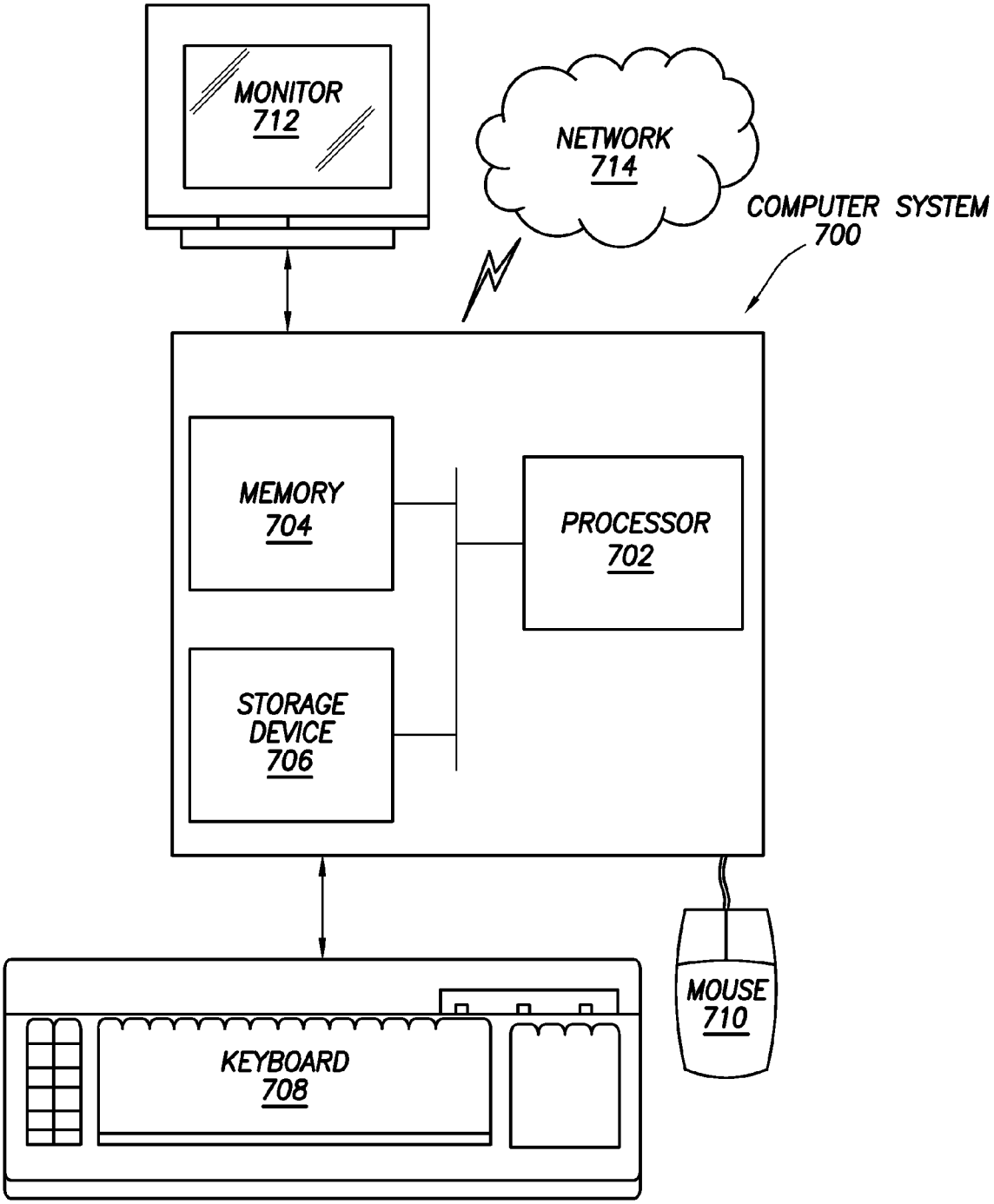
FIG. 7 shows a computer system in accordance with one or more embodiments.

Embodiments may be implemented on virtually any type of computer regardless of the platform being used. For example, as shown in FIG. 7, a computer system (700) includes one or more processor(s) (702), associated memory (704) (e.g., random access memory (RAM), cache memory, flash memory, etc.), a storage device (706) (e.g., a hard disk, an optical drive such as a compact disk drive or digital video disk (DVD) drive, a flash memory stick, etc.), and numerous other elements and functionalities typical of today's computers (not shown). The computer (700) may also include input means, such as a keyboard (708), a mouse (710), or a microphone (not shown). Further, the computer (700) may include output means, such as a monitor (712) (e.g., a liquid crystal display (LCD), a plasma display, or cathode ray tube (CRT) monitor). The computer system (700) may be connected to a network (714) (e.g., a local area network (LAN), a wide area network (WAN) such as the Internet, or any other type of network) via a network interface connection (not shown). Those skilled in the art will appreciate that many different types of computer systems exist, and the aforementioned input and output means may take other forms. Generally speaking, the computer system (700) includes at least the minimal processing, input, and/or output means necessary to practice embodiments.

Further, those skilled in the art will appreciate that one or more elements of the aforementioned computer system (700) may be located at a remote location and connected to the other elements over a network. Further, embodiments may be implemented on a distributed system having a plurality of nodes, where each portion may be located on a different node within the distributed system. In one embodiment, the node corresponds to a computer system. Alternatively, the node may correspond to a processor with associated physical memory. The node may alternatively correspond to a processor or micro-core of a processor with shared memory and/or resources.

Further, computer readable program code to perform one or more of the various components of the system may be stored, permanently or temporarily, in whole or in part, on a non-transitory computer readable medium such as a compact disc (CD), a diskette, a tape, physical memory, or any other physical computer readable storage medium that includes functionality to store computer readable program code to perform embodiments. In one or more embodiments, the computer readable program code is configured to perform embodiments when executed by a processor(s).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for drilling a borehole, comprising:

obtaining, while drilling the borehole, sensor data for the drilling assembly;

analyzing, while drilling the borehole, the sensor data using a drilling behavior model to obtain results, wherein the drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length; and adjusting the drilling of the borehole based on the results.

2. The method of claim 1, wherein the drilling behavior model comprises an equation expressible as:

$$\frac{dH}{dm} = \sum_{i=1}^{i=N} (CH_i \cdot (H_i + v_i(m)) + \sum_{k=1}^{k=X} (CB_k \cdot \beta_k(m)) + \sum_{l=1}^{l=P} (CM_l \cdot M_l(m_l)) + \sum_{n=1}^{n=Q} (CF_n \cdot F_n(m)) + \sum_{r=1}^{r=Y} (CW_r \cdot w_r(m)) - CG \cdot \frac{d^2 H}{dm^2}$$

wherein N is the number of touch points, X is the number of bend angles, P is the number of external moments, Q is a number of external forces, and Y is the number of lengths of distributed weights, m is the distance drilled, H(m) is the lateral displacement of the center of borehole at the bit, $CH_i$ is a vertical displacement coefficient at an $i^{th}$ position, $v_i(m)$ is a vertical displacement from the center of the borehole at the $i^{th}$ position, $CB_k$ is an angular coefficient at a $k^{th}$ position, $\beta_k(m)$ is an angular offset at the $k^{th}$ position, $CM_l$ is a total displacement coefficient at an $l^{th}$ position, $M_l(m)$ is an external moment at the $l^{th}$ position, $CF_n$ is a coefficient of force at an $n^{th}$ position, $F_n(m)$ is a Laplace Transform of force at the $n^{th}$ position, $CW_r$ is a mass per unit length coefficient at an $r^{th}$ position, $w_r(s)$ is a mass per unit length for the $r^{th}$ position, and CG is a coefficient moment to tilt the bit.

3. The method of claim 2, wherein the drilling behavior model is expressed using a Laplace transformation and each coefficient is set as a constant.

4. The method of claim 1, wherein the drilling behavior model comprises an equation expressible as:

$$H(s) = \frac{\sum_{i=1}^{i=N} (CH_i \cdot v_i(s)) + \sum_{k=1}^{k=X} (CB_k \cdot \beta_k(s)) + \sum_{l=1}^{l=P} (CM_l \cdot M_l(s)) + \sum_{n=1}^{n=Q} (CF_n \cdot F_n(s)) + \sum_{r=1}^{r=Y} (CW_r \cdot w_r(s))}{s + CG \cdot s^2 - CH_1 - CH_2 \cdot e^{-s \cdot L_1} - \sum_{j=2}^{j=N} CH_{j+1} \cdot e^{-s \cdot L_1 j}},$$

wherein N is the number of touch points, X is the number of bend angles, P is the number of external moments, Q is a number of external forces, and Y is the number of lengths of distributed weights, H(s) is a Laplace Transform of H(m), m is the distance drilled, s is a Laplace Transform variable, H(m) is the lateral displacement of the center of borehole at the bit, $CH_i$ is a vertical displacement coefficient at an $i^{th}$ position, $v_i(s)$ is a Laplace Transform of a vertical displacement from the center of the borehole at the $i^{th}$ position, $CB_k$ is an angular coefficient at a $k^{th}$ position, $\beta_k(s)$ is a Laplace Transform of an angular offset at the $k^{th}$ position, $CM_l$ is a total displacement coefficient at an $l^{th}$ position, $M_l(s)$ is a Laplace Transform of an external moment at the $l^{th}$ position, $CF_n$ is a coefficient of force at an $n^{th}$ position, $F_n(s)$ is a Laplace Transform of force at the $n^{th}$ position, $CW_r$ is a mass per unit length coefficient at an $r^{th}$ position, $w_r(s)$ is a Laplace Transform of mass per unit length for the $r^{th}$ position, e is the base of the natural logarithm, CG is a coefficient moment to tilt the bit, $L_i$ is an element i of a drill string, $CH_{j+1}$ is a coefficient at a $(j+1)^{th}$ position, and L1*j* is a distance from element 1 to element $L_j$.

5. The method of claim 4, wherein the results of analyzing H(s) specify a stability level of the borehole.

6. The method of claim 1, wherein the drilling behavior model predicts at least one selected from a group consisting of a lateral displacement, an angular orientation, and a curvature of the borehole at a predefined point.

7. The method of claim 1, wherein the drilling behavior model identifies a failure of the borehole based on at least one coefficient of the drilling behavior model exceeding a predefined threshold.

8. The method of claim 1, wherein the drilling behavior model models the drilling of the borehole when a working actuator is used to compensate for a failed actuator.

9. The method of claim 1, wherein the drilling behavior model is executed downhole within a downhole steering tool, and the drilling is adjusted by the downhole steering tool.

10. The method of claim 9, wherein adjusting the drilling of the borehole comprises:

modifying, while the drilling assembly is located downhole, a position of at least one stabilizer on the drilling assembly in response to the results.

11. The method of claim 9, wherein adjusting the drilling of the borehole comprises:

modifying, while the drilling assembly is located downhole, a diameter of at least one stabilizer on the drilling assembly in response to the results.

12. The method of claim 9, wherein adjusting the drilling of the borehole comprises:

modifying, while the drilling assembly is located downhole, a bit in response to the results, wherein modifying the bit comprises modifying at least one selected from a group consisting of a shape of a gauge of the bit and a position of a cutter on the bit, and a position of snubbers on the bit.

13. The method of claim 9, wherein adjusting the drilling of the borehole comprises:

modifying, while the drilling assembly is located downhole, at least one selected from a group consisting of a lateral force and position of at least one actuator in response to the results.

14. The method of claim 9, wherein adjusting the drilling of the borehole comprises:

modifying, while the drilling assembly is located downhole, a bottom hole assembly on the drilling assembly in response to the results by performing at least one selected from a group consisting of modifying a weight of the bottom hole assembly and a cross section of a tubular in the bottom hole assembly.

15. The method of claim 1, further comprising:

analyzing the results to identify a shape of the hole.

16. The method of claim 1, wherein the model models behavior of a downhole assembly lacking any subsurface steering element.

17. The method of claim 1, further comprising:

creating an orthogonal model to analyze the drilling in three dimensions.

18. The method of claim 1, wherein the drilling behavior model models drilling using a drilling assembly comprising a hole opener and a bit.

19. The method of claim 1, further comprising:

obtaining, while drilling the borehole, initial sensor data for the drilling assembly;

analyzing, to obtain initial results, the initial sensor data using the drilling behavior model;

obtaining an actual drilling behavior of the drilling assembly;

comparing the initial results and the actual drilling behavior to identify a discrepancy; and refining, in response to identifying the discrepancy, at least one coefficient of the drilling behavior model.

20. A method for generating a drilling behavior model, the method comprising:

obtaining, while drilling the borehole, initial sensor data for the drilling assembly;

generating, while drilling the borehole, a partial set of coefficients using the initial sensor data;

obtaining, while drilling the borehole, an actual drilling behavior of the drilling assembly;

computing, while drilling the borehole and using the partial set of coefficients in the drilling behavior model and the actual drilling behavior, a remaining set of coefficients to create a complete set of coefficients, wherein the drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length; and storing, the complete set of coefficients, wherein the complete set of coefficients are used in the drilling behavior model to manage the drilling of the borehole.

21. The method of claim 20, wherein the drilling behavior model comprises an equation expressible as:

$$\frac{dH}{dm} = \sum_{i=1}^{i=N} (CH_i \cdot (H_i + v_i(m)) + \sum_{k=1}^{k=X} (CB_k \cdot \beta_k(m)) + \sum_{l=1}^{l=P} (CM_l \cdot M_l(m_l)) + \sum_{n=1}^{n=Q} (CF_n \cdot F_n(m)) + \sum_{r=1}^{r=Y} (CW_r \cdot w_r(m)) - CG \cdot \frac{d^2 H}{dm^2}$$

wherein N is the number of touch points, X is the number of bend angles, P is the number of external moments, Q is a number of external forces, and Y is the number of lengths of distributed weights, m is the distance drilled, H(m) is the lateral displacement of the center of borehole at the bit, $CH_i$ is a vertical displacement coefficient at an $i^{th}$ position, $v_i(m)$ is a vertical displacement from the center of the borehole at the $i^{th}$ position, $CB_k$ is an angular coefficient at a $k^{th}$ position, $\beta_k(m)$ is an angular offset at the $k^{th}$ position, $CM_l$ is a total displacement coefficient at an $l^{th}$ position, $M_l(m)$ is an external moment at the $l^{th}$ position, $CF_n$ is a coefficient of force at an $n^{th}$ position, $F_n(m)$ is a Laplace Transform of force at the $n^{th}$ position, $CW_r$ is a mass per unit length coefficient at an $r^{th}$ position, $w_r(s)$ is a mass per unit length for the $r^{th}$ position, and CG is a coefficient moment to tilt the bit.

22. The method of claim 20, wherein the drilling behavior model comprises an equation expressible as:

$$H(s) = \frac{\sum_{i=1}^{i=N} (CH_i \cdot v_i(s)) + \sum_{k=1}^{k=X} (CB_k \cdot \beta_k(s)) + \sum_{l=1}^{l=P} (CM_l \cdot M_l(s)) + \sum_{n=1}^{n=Q} (CF_n \cdot F_n(s)) + \sum_{r=1}^{r=Y} (CW_r \cdot w_r(s))}{s + CG \cdot s^2 - CH_1 - CH_2 \cdot e^{-s \cdot L_1} - \sum_{j=2}^{j=N} CH_{j+1} \cdot e^{-s \cdot L_1 j}},$$

wherein N is the number of touch points, X is the number of bend angles, P is the number of external moments, Q is a number of external forces, and Y is the number of lengths of distributed weights, H(s) is a Laplace Transform of H(m), m is the distance drilled, s is a Laplace Transform variable, H(m) is the lateral displacement of the center of borehole at the bit, $CH_i$ is a vertical displacement coefficient at an $i^{th}$ position, $v_i(s)$ is a Laplace Transform of a vertical displacement from the center of the borehole at the $i^{th}$ position, $CB_k$ is an angular coefficient at a $k^{th}$ position, $\beta_k(s)$ is a Laplace Transform of an angular offset at the $k^{th}$ position, $CM_l$ is a total displacement coefficient at an $l^{th}$ position, $M_l(s)$ is a Laplace Transform of an external moment at the $l^{th}$ position, $CF_n$ is a coefficient of force at an $n^{th}$ position, $F_n(s)$ is a Laplace Transform of force at the $n^{th}$ position, $CW_r$ is a mass per unit length coefficient at an $r^{th}$ position, $w_r(s)$ is a Laplace Transform of mass per unit length for the $r^{th}$ position, e is the base of the natural logarithm, CG is a coefficient moment to tilt the bit, $L_i$ is an element i of a drill string, $CH_{j+1}$ is a coefficient at a $(j+1)^{th}$ position, and L1*j* is a distance from element 1 to element $L_j$.

23. The method of claim 20, further comprising:

obtaining, while drilling the borehole, new sensor data for the drilling assembly;

analyzing, to obtain results, the new sensor data using the drilling behavior model and the complete set of coefficients; and adjusting the drilling of the borehole based on the results.

24. A system for drilling a borehole, comprising:

a data repository for storing sensor data and a plurality of coefficients;

a model execution hardware for executing a model engine, the model engine comprising instructions for:

obtaining, while drilling the borehole, sensor data for the drilling assembly;

analyzing, while drilling the borehole, the sensor data using a drilling behavior model to obtain results, wherein the drilling behavior model models drilling of the borehole using a distance drilled, a number of touch points, a number of bend angles, a number of external moments, a number of lengths of distributed weights, a lateral displacement of a center of the borehole at a bit, at least one vertical displacement from the center of the borehole, at least one angular offset, at least one force, and at least one mass per unit length; and adjusting the drilling of the borehole based on the results.

25. The system of claim 24, wherein the drilling behavior model comprises an equation expressible as:

$$\frac{dH}{dm} = \sum_{i=1}^{i=N} (CH_i \cdot (H_i + v_i(m)) + \sum_{k=1}^{k=X} (CB_k \cdot \beta_k(m)) + \sum_{l=1}^{l=P} (CM_l \cdot M_l(m_l)) + \sum_{n=1}^{n=Q} (CF_n \cdot F_n(m)) + \sum_{r=1}^{r=Y} (CW_r \cdot w_r(m)) - CG \cdot \frac{d^2 H}{dm^2}$$

wherein N is the number of touch points, X is the number of bend angles, P is the number of external moments, Q is a number of external forces, and Y is the number of lengths of distributed weights, m is the distance drilled, H(m) is the lateral displacement of the center of borehole at the bit, $CH_i$ is a vertical displacement coefficient at an $i^{th}$ position, $v_i(m)$ is a vertical displacement from the center of the borehole at the $i^{th}$ position, $CB_k$ is an angular coefficient at a $k^{th}$ position, $\beta_k(m)$ is an angular offset at the $k^{th}$ position, $CM_l$ is a total displacement coefficient at an $l^{th}$ position, $M_l(m)$ is an external moment at the $l^{th}$ position, $CF_n$ is a coefficient of force at an $n^{th}$ position, $F_n(m)$ is a Laplace Transform of force at the $n^{th}$ position, $CW_r$ is a mass per unit length coefficient at an $r^{th}$ position, $w_r(s)$ is a mass per unit length for the $r^{th}$ position, and CG is a coefficient moment to tilt the bit.

26. The system of claim 24, wherein the drilling behavior model comprises an equation expressible as:

$$H(s) = \frac{\sum_{i=1}^{i=N} (CH_i \cdot v_i(s)) + \sum_{k=1}^{k=X} (CB_k \cdot \beta_k(s)) + \sum_{l=1}^{l=P} (CM_l \cdot M_l(s)) + \sum_{n=1}^{n=Q} (CF_n \cdot F_n(s)) + \sum_{r=1}^{r=Y} (CW_r \cdot w_r(s))}{s + CG \cdot s^2 - CH_1 - CH_2 \cdot e^{-s \cdot L_1} - \sum_{j=2}^{j=N} CH_{j+1} \cdot e^{-s \cdot L_1 j}},$$

wherein N is the number of touch points, X is the number of bend angles, P is the number of external moments, Q is a number of external forces, and Y is the number of lengths of distributed weights, H(s) is a Laplace Transform of H(m), m is the distance drilled, s is a Laplace Transform variable, H(m) is the lateral displacement of the center of borehole at the bit, $CH_i$ is a vertical displacement coefficient at an $i^{th}$ position, $v_i(s)$ is a Laplace Transform of a vertical displacement from the center of the borehole at the $i^{th}$ position, $CB_k$ is an angular coefficient at a $k^{th}$ position, $\beta_k(s)$ is a Laplace Transform of an angular offset at the $k^{th}$ position, $CM_l$ is a total displacement coefficient at an $l^{th}$ position, $M_l(s)$ is a Laplace Transform of an external moment at the $l^{th}$ position, $CF_n$ is a coefficient of force at an $n^{th}$ position, $F_n(s)$is a Laplace Transform of force at the $n^{th}$ position, $CW_r$ is a mass per unit length coefficient at an $r^{th}$ position, $w_r(s)$ is a Laplace Transform of mass per unit length for the $r^{th}$ position, e is the base of the natural logarithm, CG is a coefficient moment to tilt the bit, $L_i$ is an element i of a drill string, $CH_{j+1}$ is a coefficient at a $(j+1)^{th}$ position, and L1*j* is a distance from element 1 to element $L_j$.

27. The system of claim 24, further comprising:

a plurality of sensors for gathering the sensor data; and drilling assembly equipment configured to:

receive the command from the model execution hardware; and self-adjust based on the command.

28. The system of claim 24, wherein the model execution hardware is a downhole steering tool.

29. The system of claim 28, wherein the downhole steering tool comprises a well plan and adjusts the drilling of the borehole based on the well plan and the results.

30. The system of claim 29, wherein the downhole steering tool is configured to obtain a set of objectives and generate the well plan.

31. The system of claim 24, wherein the data repository comprises a plurality of versions of the drilling behavior model.

* * * * *